United States Patent [19]

Olson

[11] Patent Number: 4,861,223

[45] Date of Patent: Aug. 29, 1989

[54] AUTOMATIC LOAD PUSH-PULL SLIPSHEET HANDLER

[75] Inventor: John E. Olson, Portland, Oreg.

[73] Assignee: Cascade Corporation, Portland, Oreg.

[21] Appl. No.: 154,646

[22] Filed: Feb. 9, 1988

[51] Int. Cl.[4] ..... B66F 9/20

[52] U.S. Cl. ..... 414/661; 294/103.1; 414/273; 414/275; 414/280

[58] Field of Search ..... 414/280, 661, 273, 275, 414/666, 667, 670, 671, 642, 659; 901/34, 35, 46, 47; 294/103.1, 902

[56] References Cited

U.S. PATENT DOCUMENTS

| | | | |
|---|---|---|---|
| 537,459 | 4/1895 | Hewlett | 294/103.1 |
| 2,576,482 | 11/1951 | Rydner | 414/661 |
| 2,590,355 | 3/1952 | Turner et al. | 414/661 |
| 3,142,399 | 7/1964 | Oster | 414/661 |
| 3,197,053 | 7/1965 | Faust | 414/661 |
| 3,202,303 | 8/1965 | Chasar | 414/661 X |
| 3,372,816 | 3/1968 | Atwater | 414/275 |
| 3,516,641 | 6/1970 | Ferguson | 414/661 X |
| 3,618,786 | 11/1971 | Fick | 901/34 X |
| 3,640,414 | 2/1972 | Brudi | 414/661 |
| 3,884,363 | 5/1975 | Ajlouny | 901/34 X |
| 4,122,957 | 10/1978 | Allen et al. | 414/281 |
| 4,217,074 | 8/1980 | Leasor et al. | 414/661 X |
| 4,266,106 | 5/1981 | Fraser et al. | 414/275 X |
| 4,284,384 | 8/1981 | Olson | 414/661 X |
| 4,297,070 | 10/1981 | Didtel | 414/661 X |
| 4,411,577 | 10/1983 | Shearer, Jr. | 414/273 X |
| 4,492,504 | 1/1985 | Hainsworth | 414/273 |
| 4,520,443 | 5/1985 | Yuki et al. | 414/273 X |
| 4,526,504 | 7/1985 | Hovey | 414/661 |
| 4,561,825 | 12/1985 | Sakata | 901/35 X |
| 4,624,620 | 11/1986 | Farmer et al. | 414/661 X |
| 4,714,399 | 12/1987 | Olson | 414/275 X |
| 4,734,005 | 3/1988 | Blumberg | 414/661 X |
| 4,742,468 | 5/1988 | Ohashi et al. | 414/273 X |
| 4,752,179 | 6/1988 | Seaberg | 414/667 X |
| 4,766,322 | 8/1988 | Hashimoto | 414/273 X |

FOREIGN PATENT DOCUMENTS

| | | | |
|---|---|---|---|
| 20261 | 2/1978 | Japan | 414/275 |
| 20266 | 2/1978 | Japan | 414/273 |
| 31161 | 3/1979 | Japan | 414/275 |
| 2019809 | 11/1979 | United Kingdom | 414/667 |

*Primary Examiner*—David A. Bucci

*Attorney, Agent, or Firm*—Chernoff, Vilhauer, McClung & Stenzel

[57] ABSTRACT

A load push-pull slipsheet handler is disclosed having automatic features adapting it particularly for use with driverless, automatically-guided vehicles. These features include proximity sensors which sense the distance between the slipsheet handler and a vertically-oriented external surface so as to deposit a load in a predetermined relationship to the surface either on the floor or atop another load. Load contact sensors also are provided for enabling the device to gauge the distance to a load to be picked up so as to control the approach thereto. Further sensors sense the transversely-opposite extremities of a load prior to engagement, and transversely center the push-pull assembly relative to the load. Other features include a system associated with the slipsheet clamp for sensing the presence or absence of a slipsheet tab prior to clamping, and means for permanently deforming the tab to facilitate subsequent regrasping after the load has been deposited. A vertical height sensor ensures proper elevation of the slipsheet handler for depositing a load atop another load.

12 Claims, 11 Drawing Sheets

LOAD DEPOSIT

LOAD DEPOSIT (CONT'D)

LOAD DEPOSIT (CONT'D)

LOAD PICKUP

LOAD PICKUP (CONT'D)

LOAD PICKUP (CONT'D)

AUTOMATIC LOAD PUSH-PULL SLIPSHEET HANDLER

BACKGROUND OF THE INVENTION

This invention relates to load push-pull slipsheet handlers and particularly to such slipsheet handlers having automatic features for enabling their use with driverless, automatically-guided vehicles.

Push-pull slipsheet handlers have long been employed with driver-type lift trucks for handling loads on slipsheets, as shown for example by U.S. Pat. No. 4,624,620. Some prior slipsheet handlers have been equipped with an automatic feature which aids the lift truck operator in pushing the load off of the loadsupporting forks or platen so as to deposit it in a predetermined position. As depicted, for example, in U.S. Pat. Nos. 4,297,070 and 4,284,384 which are incorporated herein by reference, the speed of forward extension of the push plate relative to the frame of the push-pull assembly can be coordinated with the rearward speed of the lift truck so that if the operator, prior to push plate extension, positions the load in a predetermined position, the push plate will then deposit the load automatically in that position by pushing the load forwardly and moving the lift truck rearwardly simultaneously at identical speeds. However, the initial positioning of the load prior to push-off requires the presence of a lift truck operator.

Other aspects of the operation of a load push-pull slipsheet handler which require the presence of an operator are the regulation and stopping of the approach of the slipsheet handler to a load, the transverse centering of the slipsheet handler relative to the load, the positioning of the slipsheet clamp to properly grasp the tab of the slipsheet, regulation of the degree of push plate retraction with loads of different depths to ensure that the platen does not dangerously protrude forwardly of the load, and vertical position regulation of the slipsheet handler, particularly when depositing a load at an elevated position atop another load. Accordingly, the requirement for an operator has heretofore rendered impractical the use of load push-pull slipsheet handlers with automatically-guided vehicles.

Other automatic load-handling devices have been marketed in the past for automatically-guided vehicles, such as the automatic load clamp shown in U.S. Pat. No. 4,714,399. However, the automatic sensors and functions of an automatic load clamp are not applicable to the problems of a load push-pull slipsheet handler, which operates in a completely different manner than a load clamp. The same is true with respect to the features of prior automatic fork-equipped load handlers, such as that shown in U.S. Pat. No. 4,122,957.

Another problem of load push-pull slipsheet handlers, whether or not operated by a driver, is ensuring that a slipsheet tab remains in condition for regrasping by a slipsheet clamp after the load has been deposited. The problem can occur, for example, if a second load is deposited against the side of a first load from which the slipsheet tab protrudes, causing accordion-type folding or crushing of the tab so that it no longer protrudes from the bottom of the load in an engageable manner. Alternatively, the slipsheet tab may be cut or torn by certain types of prior slipsheet clamps having irregular jaw shapes which concentrate gripping pressure on the tab to prevent its slipping from the jaws. Examples of such irregular jaw shapes are shown in U.S. Pat. Nos. 2,576,482, 3,142,399, 3,197,053, and 3,516,641. All of these have a transverse notch formed in the lower jaw of the slipsheet clamp having an upwardly-protruding shoulder on the forward side of the notch for ensuring good gripping. Unfortunately, the concentration of gripping pressure on the tab due to the forward shoulder tends to crush or tear the tab material making it unsuitable for future regrasping.

SUMMARY OF THE PRESENT INVENTION

The present invention overcomes the aforementioned deficiencies of prior load push-pull slipsheet handlers by providing sensors, and functions automatically responsive to such sensors, which obviate the need for human supervision of such slipsheet handlers and thereby adapt them for use with driverless, automatically-guided vehicles. The features of the present invention are not, however, limited to driverless applications since they would also facilitate operation of such slipsheet handlers by operators, particularly under conditions of limited operator visibility.

Depositing of loads in predetermined positions without operator supervision is accomplished by one or more sensors which sense the presence of a vertically-oriented surface, of either a wall or another load located forwardly of the slipsheet handler, and the proximity of such surface to the slipsheet handler. A controller responsive to the sensor then positions the slipsheet handler so as to deposit the load in a predetermined relationship to such surface. For example, for floor deposit, the forward extremity of the load can be deposited in predetermined relationship to the vertical surface of a wall or other load located forwardly thereof by using the sensors to properly preposition the slipsheet handler relative to such surface and then using the coordinated push-off feature of the aforementioned U.S. Pat. Nos. 4,297,070 and 4,284,384 to deposit the load. Alternatively, for depositing a load atop another load, the face of the load to be deposited can be aligned with the face of the underlying load, even though the two loads may have different depths, by using the sensors to properly preposition the slipsheet handler relative to the face of the underlying load. In such case, in order to render more precise the desired vertical alignment of the faces of the upper and lower loads, respectively, a sensor is provided on the push plate for sensing the proximity of the lower load face to the push plate and regulating the extension of the push plate as the vehicle withdraws from the load so as to maintain the push plate in a predetermined relationship to the face of the underlying load. Depositing of a load atop another load is further regulated by height sensing of the top of the underlying load to ensure proper vertical positioning of the slipsheet handler.

For load pick-up, retarding and stopping of the slipsheet handler during approach to the load is controlled automatically in response to a sensor which senses the face of the load and the proximity thereof to the push plate. Moreover, proper engagement of a load during pick-up is ensured by numerous automatic functions. These include load width sensors for sensing the transversely-opposite extremities of the load, in response to which the push-pull assembly is automatically transversely centered on the load. Also, a slipsheet tab sensor determines whether or not the tab is properly within the jaws of the slipsheet clamp prior to gripping, and initiates a clamp position self adjustment procedure if it is not. After clamping, other sensors determine whether the load is actually being pulled onto the slipsheet handler. Finally, the crushing or folding of the slipsheet tab when other loads are pushed against it, which would render it incapable of regrasping by the slipsheet clamp, is prevented by a tab folder on the slipsheet clamp which automatically permanently deforms the tab upwardly when engaging it to prevent subsequent crushing or folding of the tab.

The foregoing and other objectives, features, and advantages of the invention will be more readily understood upon consideration of the following detailed description of the invention, taken in conjunction with the accompanying drawings.

DETAILED DESCRIPTION OF THE INVENTION

GENERAL ARRANGEMENT

Figure 1:
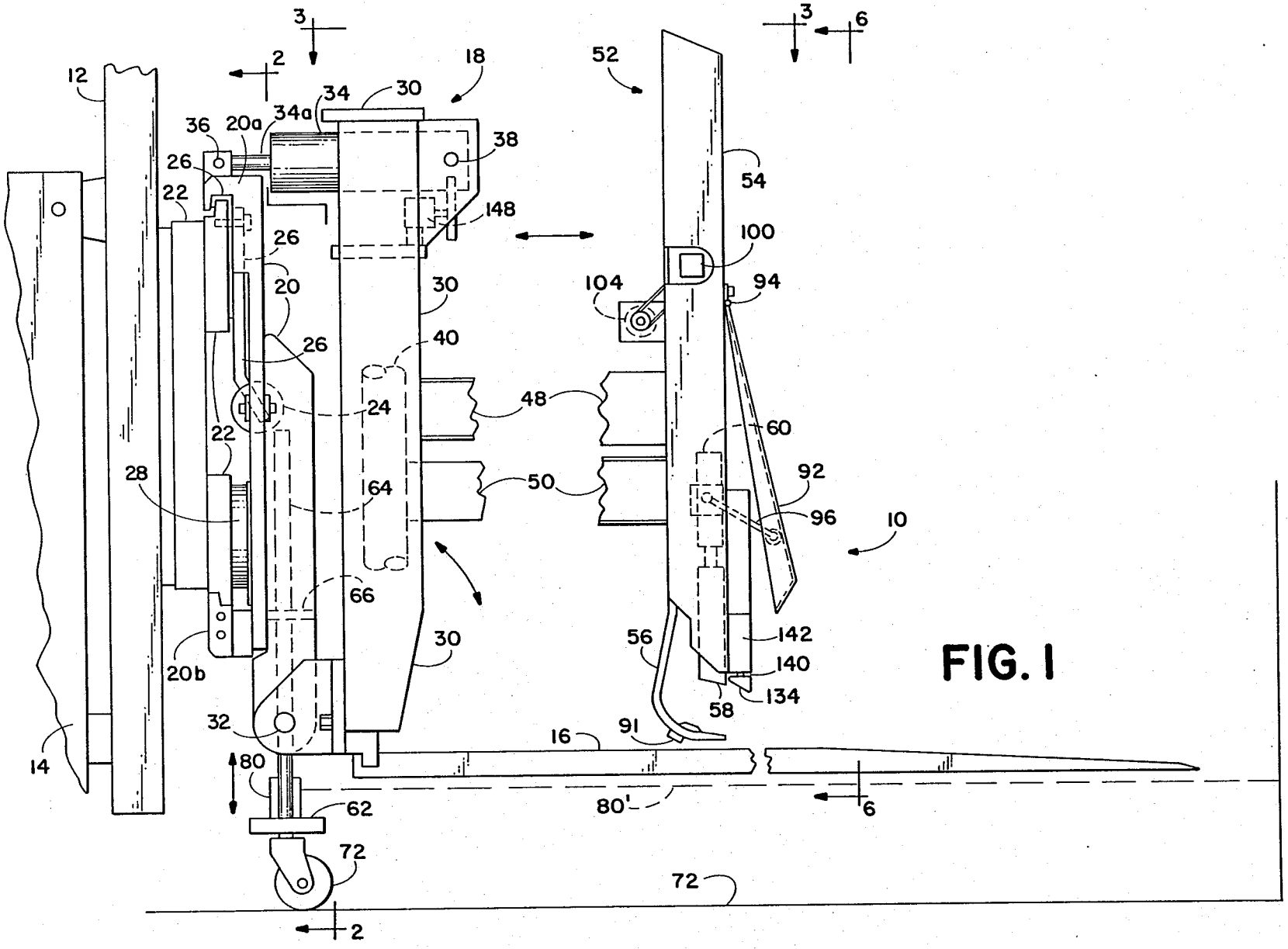
FIG. 1 is an extended side view of an exemplary embodiment of the automatic load push-pull slipsheet handler of the present invention.

An exemplary embodiment of an automatic load push-pull slipsheet handler in accordance with the present invention is indicated generally as 10 in FIG. 1. The slipsheet handler is mounted for vertical reciprocation on the mast 12 of a materials handling vehicle 14 which is preferably of the automatically-guided, driverless type but which may, alternatively, be operated by a driver. The slipsheet handler comprises a forwardly-extending load-carrying platen structure which, preferably, comprises a transversely-spaced pair of platens 16 cantilevered forwardly from the frame of the push-pull assembly, indicated generally as 18 in FIG. 1.

Figure 2:
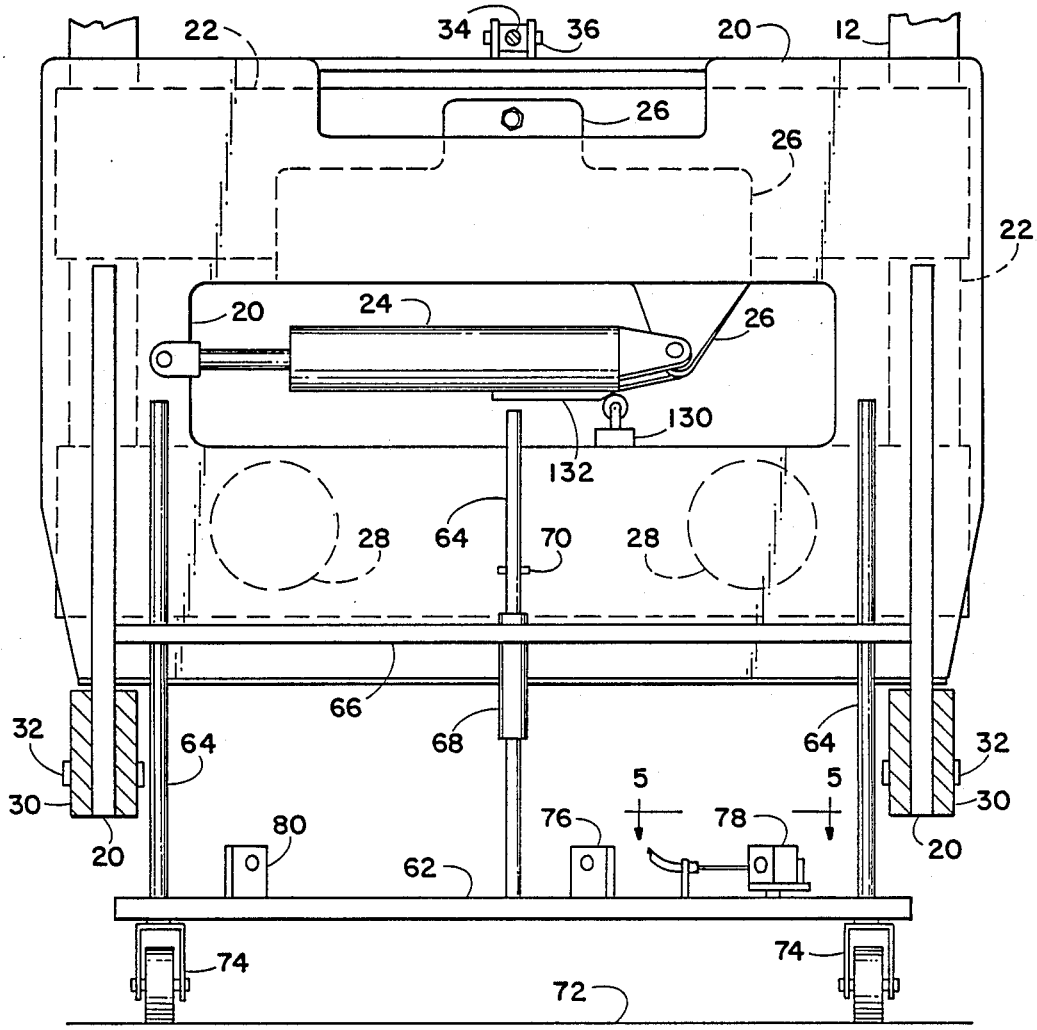
FIG. 2 is a cross-sectional view of the frame of the push-pull slipsheet handler taken along line 2—2 of FIG. 1.

The frame 18 comprises a rear portion 20 connected to the carriage 22 of the mast 12 by upper and lower hooks **20*a* and 20*b*, respectively. These hooks are slidable transversely relative to the carriage 22 by actuation of a double-acting sideshift hydraulic cylinder 24 interposed between a hook-type bracket 26 affixed to the carriage 22 (FIGS. 1 and 2) and the rear portion 20 of the frame 18 in a manner similar to that shown in U.S. Pat. No. 4,406,575, which is incorporated herein by reference. The rear portion 20 of the frame 18 is aided in its transversely slidable movement with respect to the carriage 22 by a pair of rearwardly-facing bushings 28 mounted thereon which slidably abut the face of the carriage 22**.

The frame 18 also includes a front portion 30 hingedly attached to the rear portion 20 by pivot pins 32, and tiltable forwardly and rearwardly with respect to the rear portion 20 in response to the selective extension or retraction of a double-acting hydraulic tilt cylinder 34. The tilt cylinder has a piston rod **34*a* pivotally connected by a pin 36 to the rear portion 20 of the frame 18, and a base pivotally connected by a pin 38 to the front portion 30 of the frame 18. Since the platens 16 are mounted on the front portion 30 of the frame, they are tiltable up and down in unison with the tilting of the front portion 30 in response to the actuation of the hydraulic cylinder 34. Although not shown, the transverse positions of the platens 16 are preferably adjustable by power means, such as further double-acting hydraulic cylinders, mounted on the front portion 30 of the frame 18**.

Figure 3:
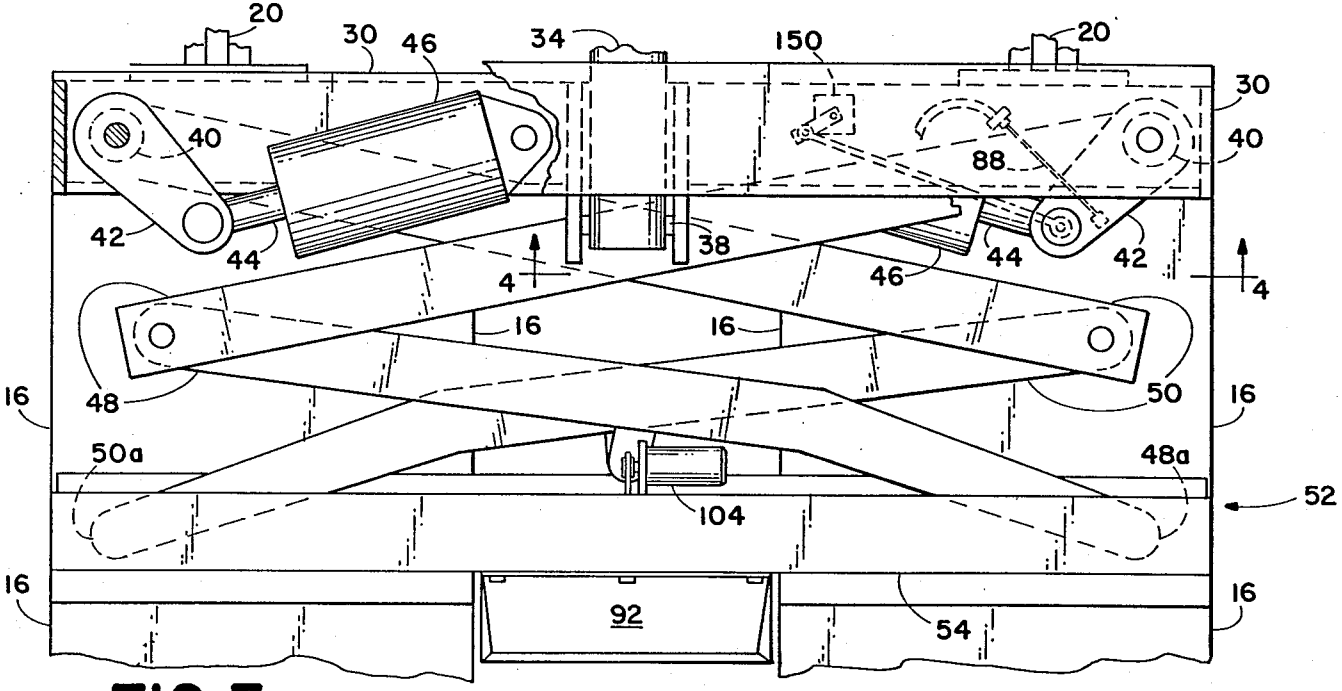
FIG. 3 is a top view of the push-pull slipsheet handler taken along line 3—3 of FIG. 1.

With reference to FIGS. 1 and 3, the front portion 30 of the frame has a pair of vertically-oriented shafts 40 extending along the respective transverse sides thereof and journaled thereto at their tops and bottoms so as to permit them to pivot about their longitudinal vertical axes. At the top of each shaft 40 is a respective lever arm 42 to which is connected the piston rod 44 of a respective one of a pair of double-acting hydraulic push-pull cylinders 46. Fixedly connected perpendicularly to each of the shafts 40 is a respective upper pair of hinged links 48 or lower pair of hinged links 50 pivotally connected at their forward ends **48*a* and 50*a*, respectively, to a push plate 52 so as to pivot about respective vertical axes relative to the push plate. Upon selective extension of the hydraulic cylinders 46, the shafts 40 are forced to rotate under the torque imposed by the lever arms 42 so as to extend the links 48 and 50, and thus the push plate 52, forwardly while, upon retraction of the cylinders 46, the shafts 40 rotate in the opposite direction retracting the links 48 and 50 and the push plate 52** rearwardly.

The push plate 52 comprises a transversely extending, generally upright load push frame 54 having mounted thereon a slipsheet gripper clamp comprising a transversely-extending fixed lower jaw 56 and vertically movable upper jaw 58. The upper jaw 58 is selectively extensible and retractable vertically with respect to the fixed lower jaw 56 by means of a pair of doubleacting hydraulic cylinders such as 60 (FIG. 1) mounted on the push plate.

SENSORS

In order to enable the push-pull slipsheet handler to operate automatically without human supervision, the handler is equipped with numerous sensors having different functions.

1. Long-distance, Short-distance, and Stack Face Proximity Sensors

Electro-optical proximity sensors, preferably operating in the infrared range, are mounted on a transverse sensor bar 62 which is suspended in a vertically slidable manner from the rear portion 20 of the frame 18 by means of three vertical rods 64 (FIGS. 1 and 2), each rod slidably protruding through an aperture in a cross member 66 of the rear portion 20 of the frame 18, and the middle rod 64 being slidably surrounded by a sleeve 68 to provide rigidity to the sensor bar assembly. Any suitable means, such as one or more pins 70 (FIG. 2), can act as stops to limit the degree to which the sensor bar 62 can slide downwardly when the slipsheet handler is elevated by the mast 12. When the slipsheet handler is lowered into proximity with the floor 72, casters 74 support the sensor bar 62 vertically while permitting the vehicle 14 to move in any direction and permitting side shifting by actuation of cylinder 24 if necessary. Mounted on the sensor bar 62 is a proximity sensor assembly consisting of a pair of light sources 76 and 78, and a light detector 80. The purpose of this proximity sensor assembly is to sense the presence of a vertically-oriented surface forwardly of the slipsheet handler (which may be a wall or the vertical face of another load) and sense the distance to such surface. As is the case with all of the electro-optical sensors discussed herein, sensors operating on ultrasonic or radar principles may alternatively be used.

The fact that the vertically-movable sensor bar 62 is capable of positioning the proximity sensor assembly below the load-supporting surface of the platens 16 is significant in that it permits sensing of vertical surfaces forwardly of the device while a load is being carried thereon, thus enabling the sensor assembly to be used for load deposit maneuvers as well as load pick-up maneuvers. The sensor bar 62 is preferably sufficiently retractable that the bottoms of the casters 74 will rise above the bottoms of the platens 16 to permit full lowering of the platens 16 to the floor 72.

Figure 8:
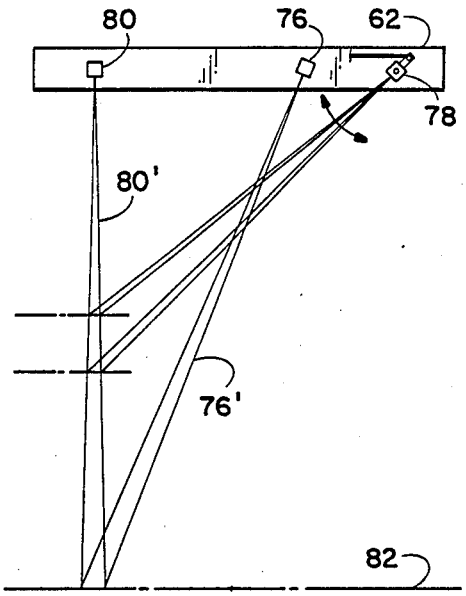
FIG. 8 is a schematic diagram showing the principle of operation of the long-distance and short-distance proximity sensors of the push-pull slipsheet handler.

With reference to FIG. 8, the combination of the light source 76 (referred to herein as the "long-distance source") and the detector 80 is designated as the "long-distance sensor." The source 76 is fixedly mounted to the bar 62 so as to project a conical beam of light at a fixed transverse angle relative to the bar along the path 76' in FIG. 8. The detector 80 is likewise fixedly oriented with respect to the bar 62 so as to detect light with maximum sensitivity received along a conical path 80'. When an external vertical surface is remote from the point of intersection of the paths 76' and 80', i.e. either nearer to or further away from the detector 80 than the point of intersection of the two paths, the spot of light projected by the conical source path 76' on the surface is outside of the conical receiving path 80' of the detector 80. However, as the external vertical surface becomes closer to the point of intersection of the paths 76' and 80' with movement of the vehicle, the projected spot of light begins to overlap the receiving path 80' and the intensity of the light received by the detector 80 begins to increase (the detector 80 sees the spot of light even though the angles of incidence and reflection are not equal, because the surface is sufficiently rough that it reflects light in all directions). As the detector 80 approaches a vertical surface corresponding to the phantom line 82 in FIG. 8, it will detect a predetermined threshold intensity when the surface is at a predetermined point beyond the point of full intersection of the paths 76' and 80' due to the partial overlap of the two paths at the surface, which intensity rises to a maximum when the surface 82 is coincident with the point of intersection, causing complete overlap, and then decreases to the predetermined threshold intensity when the surface 82 is at a second predetermined point nearer to the detector 80 than to the point of intersection, once more causing a partial overlap. Thus, at least two different predetermined distances between the detector 80 and the vertical surface 82 can be sensed as the detector 80 approaches the surface 82. The long distance source 76 and detector 80 are oriented so that the point of full intersection of the paths 76' and 80' is at a predetermined distance (e.g., six inches) beyond the forward tips of the platens 16 so as to be useful in detecting the vehicle's approach to a wall or the vertical face of another load in order to floor-deposit a load in predetermined relationship with such wall or load face.

Figure 9:
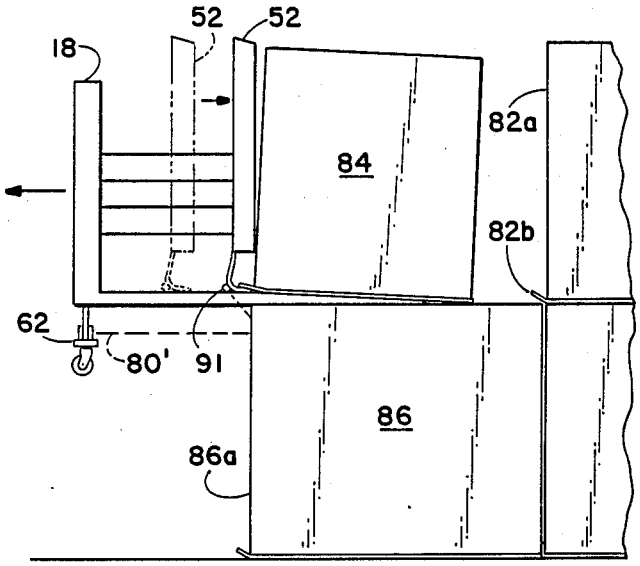
FIG. 9 is a schematic diagram showing the deposit of a load atop another load by the push-pull slipsheet handler.

A "short-distance sensor" composed of a short-distance source 78 and the detector 80, operates on the same principle as the long-distance sensor, except that the source 78 is pivotally mounted to the sensor bar 62 so as to produce different points of intersection with the path 80', all closer to the detector 80 than the long-distance point of intersection. The purpose of the short-distance sensor is for use in depositing a load atop another load, as will now be explained with additional reference to FIG. 9. If it were desired to deposit an upper load 84 atop a lower load 86 as shown in FIG. 9, the long-distance sensor could conceivably sense the approach to the surface **82*a* of another load and deposit the load in relationship to such surface just as though the deposit were being made on the floor. The problem with such method, however, is that it is desirable that the vertical faces of stacked loads be aligned vertically to facilitate subsequent slipsheet engagement and, if the upper and lower loads are not of the same depth (as shown in FIG. 9), or if no vertical surface exists where the surface 82*a* is pictured, vertical alignment of the load faces cannot be obtained in an automatic fashion by use of the long-distance sensor. To solve this problem the short-distance sensor, employing a point of intersection nearer to the detector 80 than the tips of the platens 16, is used to sense the approach of the slipsheet handler to the face 86*a* of the lower load 86. To enable use of the short-distance sensor for loads of different depths which are carried with the push plate 52 at different degrees of extension, the point of intersection is made variable by the controlled pivoting of the light source 78 in response to the extensible position of the push plate, so that the point of intersection corresponds (preferably with a predetermined offset) to the front of the push plate 52 where the face of the upper load 84 is known to be. Thus, the short-distance sensor can detect the proximity, in a forward direction, of the face 86*a* of the lower load 86 to the push plate and thus to the face of the upper load 84, regardless of the degree of extension of the push plate. This enables the unit to deposit the load 84 atop the load 86** with their respective faces vertically aligned.

Figure 4:
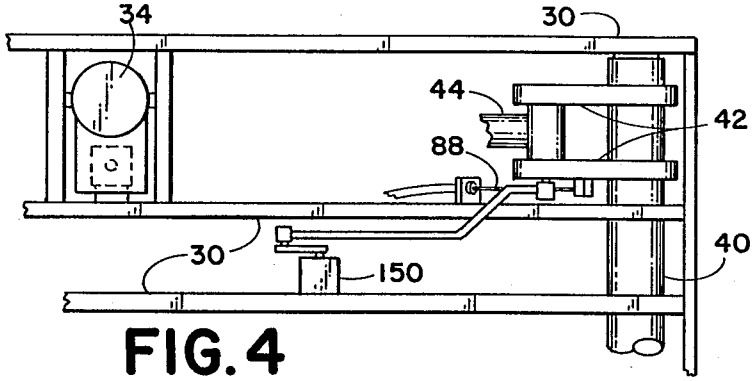
FIG. 4 is a partial front view of the frame of the push-pull assembly taken along line 4—4 of FIG. 3.
Figure 5:
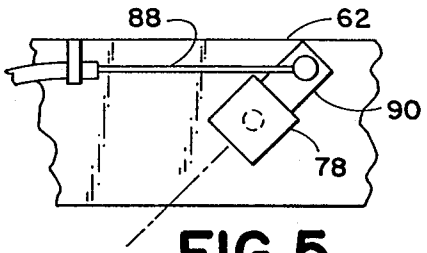
FIG. 5 is an enlarged top view of a portion of a sensor-mounting bar taken along line 5—5 of FIG. 2.

The manner in which the pivotal position of the light source 78 is coordinated with the extensible position of the push plate 52 relative to the frame 18 is seen in FIGS. 3, 4 and 5. A lever arm 42 of one of the shafts 40, whose degree of vertical rotation is responsive to the degree of extension of the push plate 52 relative to the frame 18, has a flexible push-pull cable 88 interconnecting it with a corresponding lever 90 (FIG. 5) on the pivotal light source 78. Thus, as the push plate 52 is extended, the lever 42 pulls on the cable 88 which, in turn, pulls on the lever 90. This pivots the light source 78 so as to move the point of intersection, of its light path with the path 80' of the detector, further forwardly of the detector. Conversely, rotation of the lever 42 in a direction corresponding to the reaction of the push plate 52 pushes on the cable 88 and pivots the light source 78 in a direction to bring the point of intersection closer to the detector 80. Thus, the short-distance sensor is able to determine the proximity of the face 86*a* of the bottom load 86 to the push plate 52 regardless of the extensible position of the push plate 52 relative to the frame 18.

While serving as a forward proximity sensor, detector 80 also serves as a lower load height sensor for use in depositing an upper load such as 84 atop a lower load such as 86. Thus, by raising the slipsheet handler above the top of the lower load 86 in FIG. 9, prior to deposit of the load 84, the point where the detector 80 no longer senses the presence of the face 86*a* of the lower load is recorded as the height of the top of the load 86, and utilized to determine how far to lower the slipsheet handler in preparation for deposit.

Another sensor related to the long-distance and short-distance proximity sensors is a stack face proximity sensor 91 (FIGS. 1 and 6) fixedly mounted to the underside of the lower jaw 56 of the slipsheet clamp in the space between the platens 16. This electrooptical sensor is forwardly and downwardly directed and comprises both a light source and a detector. Its purpose, with reference to FIG. 9, is to sense the face 86*a* of the lower load 86 during load push-off and control the extension of the push plate during withdrawal of the vehicle so that the push plate neither overshoots nor undershoots the face 86*a*, thereby insuring vertical alignment of the faces of the upper and lower loads when the load depositing procedure is completed.

2. Load Contact Proximity Sensor

A further sensor comprises a load-contact plate 92 pivotally mounted by a transverse hinge 94 to the front of the push plate 52. The load-contact plate 92 is normally held in an upwardly-tilted position as shown in FIG. 1 by an upwardly spring-loaded pair of arms 96 of a two-switch, normally open, switch assembly 98. In the normally open position of the switch assembly as shown in FIG. 1, the front of the load-contact plate 92 protrudes approximately two inches in front of the push plate. Upon first contact with a load surface, sufficient to depress arms 96 only slightly, a first, or "bump," switch within the switch assembly 98 closes, thereby transmitting a signal. Upon full depression of the plate 92 against the push plate, a second, or "full contact," switch closes transmitting a second signal. These signals are utilized for automatic load pick-up in a manner to be described hereafter.

3. Load Width Sensors

Figure 6:
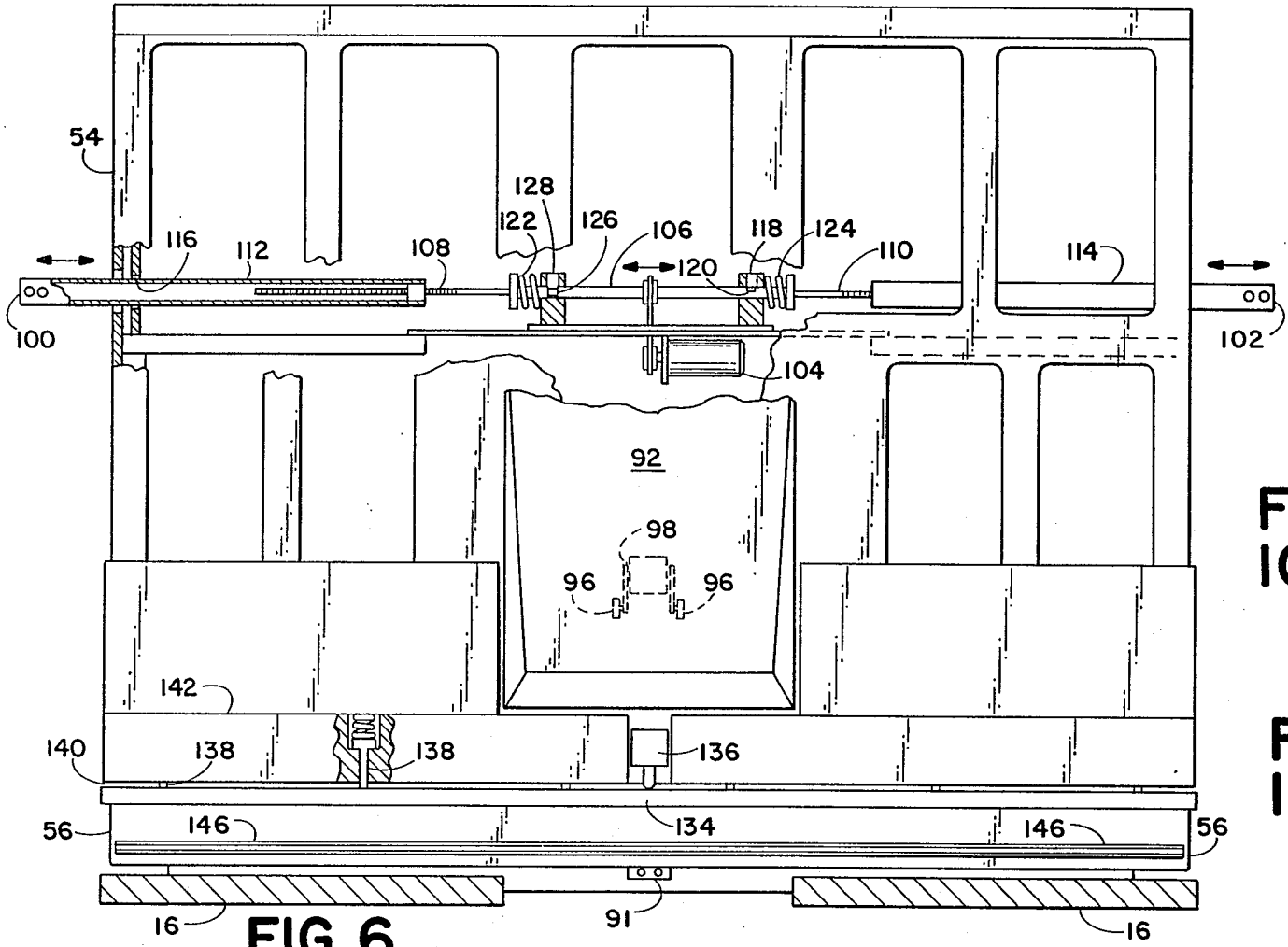
FIG. 6 is a front view of the push plate of the push-pull slipsheet handler taken along line 6—6 of FIG. 1, with portions broken away to show underlying structure.

Other sensors related to the pick-up of a load include electro-optical load width sensors 100 and 102 for sensing the positions of the transversely-opposite extremities of a load. As best seen in FIG. 6, these sensors are mounted on the push plate 52 and are capable of being selectively extended and retracted transversely with respect to the push plate by a motor 104 which drives a shaft 106 which in turn drives a pair of oppositely-threaded screws 108 and 110. Each screw is connected to a respective hollow rectangular rod 112, 114 which passes slidably through a mating rectangular aperture such as 116 in the side of the push plate and thus prevents turning of the rod. At the end of each rod is a respective sensor 100 or 102 consisting of both a light source and a detector operating as a proximity sensor similar to sensors 80 and 91 discussed previously. Normally, the load width sensors 100 and 102 are retracted into the push plate 52 so that there is no danger of their striking obstacles. However, in preparation for picking up a load, upon the first contact of the load contact plate 92 with the load, the centering sensors 100 and 102 are extended by the motor 104 to a width slightly greater than the expected width of the load, while further advancement toward the load is halted. If the sensors 100 and 102, when extended, do not sense the facing load surface within their predetermined proximity range, it means that they are both beyond the transversely-opposite extremities of the load and that the push-pull assembly is therefore sufficiently centered on the load to pick it up. On the other hand, if both sensors do sense the facing load surface, it means that the load is too wide and an error signal is generated. If one, but not both, of the sensors detects the load face within its predetermined proximity range, then the push-pull assembly is not sufficiently centered on the load and the disparity of the signals from the two sensors causes actuation of the sideshift cylinder 24 to move the push-pull assembly transversely toward the sensor which is sensing the presence of the load face until the signals from both sensors are the same. Then the load is engaged by the slipsheet clamp and pulled onto the platens 16, after which the push-pull assembly is centered relative to the vehicle 14 for load transporting.

The extensible positions of the sensors 100 and 102 relative to the push plate 52 are sensed by a conventional magnetic rotary encoder 118 which counts the revolutions of the shaft 106 by sensing the change in magnetic field which occurs with each revolution by the passing of a flat portion 120 on the shaft 106. The shat 106 is transversely slidably biased to a center position by coil springs 122 and 124. To avoid inadvertently extending the sensors 100 and 102 into an obstacle, another sensor is provided to determine if resistance to either of the sensors 100 and 102 is encountered during their extension. If so, the shaft 106 slides in the opposite direction, causing a groove 126 in the shaft to be offset from a magnetic interference switch 128. This offset signals a malfunction, interrupting extension and causing the motor 104 to retract the sensors.

A switch 130 (FIG. 2) is mounted on the rear portion 20 of the frame 18 and has a wheel which interacts with a bar 132 on the sideshift cylinder 24 to indicate, by change of state, when the push-pull assembly is centered with respect to the vehicle 14.

4. Slipsheet Tab Sensor

Figure 10A:
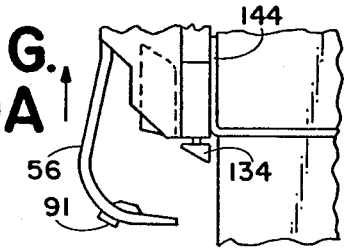
FIGS. 10A–10D are sequence diagrams showing the operation of the slipsheet tab sensor during the engagement of a load supported atop another load.
Figure 10B:
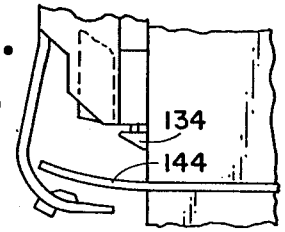
Figure 10C:
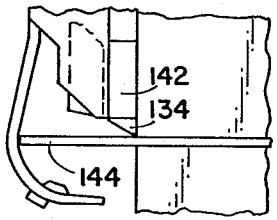
Figure 10D:
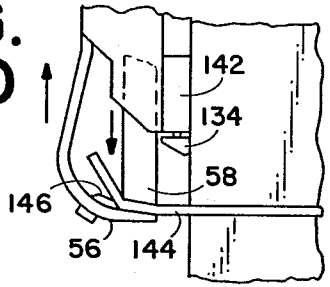

A further sensor involved in the pick-up of a load and, in particular, a load supported upon another load, is a slipsheet sensor consisting of an elongate, transversely-extending slipsheet tab sensor bar 134 and tab sensor switch 136 mounted adjacent to and forwardly of the upper jaw 58 of the slipsheet clamp. As seen in FIG. 6, the tab sensor bar 134 is biased downwardly by a series of spring-loaded studs 138 so as to form a gap 140 between the bar 134 and its mounting member 142. The slipsheet tab sensor is utilized to detect the presence or absence of a slipsheet tab within the open gripper jaws of the slipsheet clamp in a position capable of being gripped upon closing of the jaws. Such detection is necessary when engaging loads supported by other loads, since there is no floor surface which can guide the lower jaw of the slipsheet clamp into proper position beneath the slipsheet tab, and the heights of the slipsheets are variable due to such factors as compression of the bottom load. With reference to the sequence of FIGS. 10A–10D, the slipsheet tab sensor operates by advancing the push plate 52 into close proximity to the load, with the jaw opening of the slipsheet clamp below the expected height of the slipsheet tab 144 as shown in FIG. 10A. When the load-contact plate 92 is fully depressed, the slipsheet clamp is raised upwardly by the retraction of tilt cylinder 34. As the jaw opening rises above the upwardly-bent slipsheet tab 144, the tab will spring outwardly into the jaw opening as shown in FIG. 10B. Since the upward tilting is limited, the lower jaw 56 will not rise high enough to cause the tab 144 to be withdrawn from the jaw opening. As soon as the limit of upward tilting has been reached, the tilt cylinder 34 is reversed to cause down-tilting. If the tab 144 is properly within the open jaw in a position to be clamped, such down-tilting causes the tab sensor bar 134 to abut the top of the tab and be lifted upwardly relative to the mounting member 142 against the spring pressure of studs 138 as shown in FIG. 10C, thereby closing the gap 140 between the bar 134 and the mounting member 142 and actuating the tab sensor switch 136. In response to the signal from switch 136, the slipsheet jaw is closed by extending the upper jaw actuating cylinders 60 while, at the same time, tilting the entire slipsheet handler upwardly so that the fixed lower jaw 56 rises at the same speed that the upper jaw 58 is extended as shown in FIG. 10D. This aligns the top of the platen with the bottom of the load in preparation for load pulling, and ensures that the slipsheet tab 144 is not required to move vertically during the gripping procedure which might otherwise cause it to be withdrawn from the jaws prior to their complete closure.

If, upon downward tilting in FIG. 10C, the tab sensor bar 134 does not encounter the slipsheet tab and therefore switch 136 produces no signal, the absence of the tab causes the tilt cylinder 34 to raise the slipsheet clamp to a slightly higher level than previously to repeat the foregoing procedure. The repetition of the procedure can be programmed to occur multiple times after which, if proper sensing of the tab still does not occur, an error signal is generated.

With reference to FIG. 10D, the lower jaw 56 of the slipsheet clamp is equipped with an upwardly-protruding, transversely-extending elongate shoulder 146 offset immediately rearwardly of the lower jaw's mating contact surface with the upper jaw. The purpose of the shoulder 146 is to fold or deform the tab 144 permanently upwardly in response to clamping, as shown in FIG. 10D. This makes the tab easier to regrasp during subsequent load pick-ups, and also ensures that, if another load is pushed against the tab, it will cause the tab to bend upwardly rather than be crushed or folded in an accordion-like manner which would make subsequent regrasping impossible. No similar shoulder is provided forwardly of the lower jaw's mating contact surface with the upper jaw, since any such forward shoulder would tend to cut or tear the tab 144 because of the concentration of clamping pressure which would occur between two such shoulders.

5. Tilt Sensor and Push Plate Position Sensor

Other sensors include a tilt sensor 148 (FIG. 1) for indicating the relative angular movement between the base of the tilt cylinder 34 and the front portion 30 of the frame 18 to indicate the magnitude and direction of tilt, and a push plate position sensor 150 (FIGS. 3 and 4) which is connected to one of the levers 42 and thus indicates the degree of extension of the push plate 52 relative to the frame 18. The tilt sensor 148 preferably comprises multiple switches which are closed individually in correspondence with different degrees of tilt (e.g. at 4° up-tilt, 0°, 3° down-tilt and 4° down-tilt). It is used to control and limit the degree of tilting of the slipsheet handler by controlling the actuation of tilt cylinder 34. The push plate position sensor 150 is used to limit the degree of retraction of the push plate 52, depending on the depth of the load being handled (which is preprogrammed) so that, when the load is pulled onto the platens 16, it is not pulled rearwardly of the platen tips so that they do not protrude dangerously forward of the load. The sensor 150 also detects the extension position of the push plate.

ELECTRICAL AND HYDRAULIC CIRCUITRY

Figure 7:
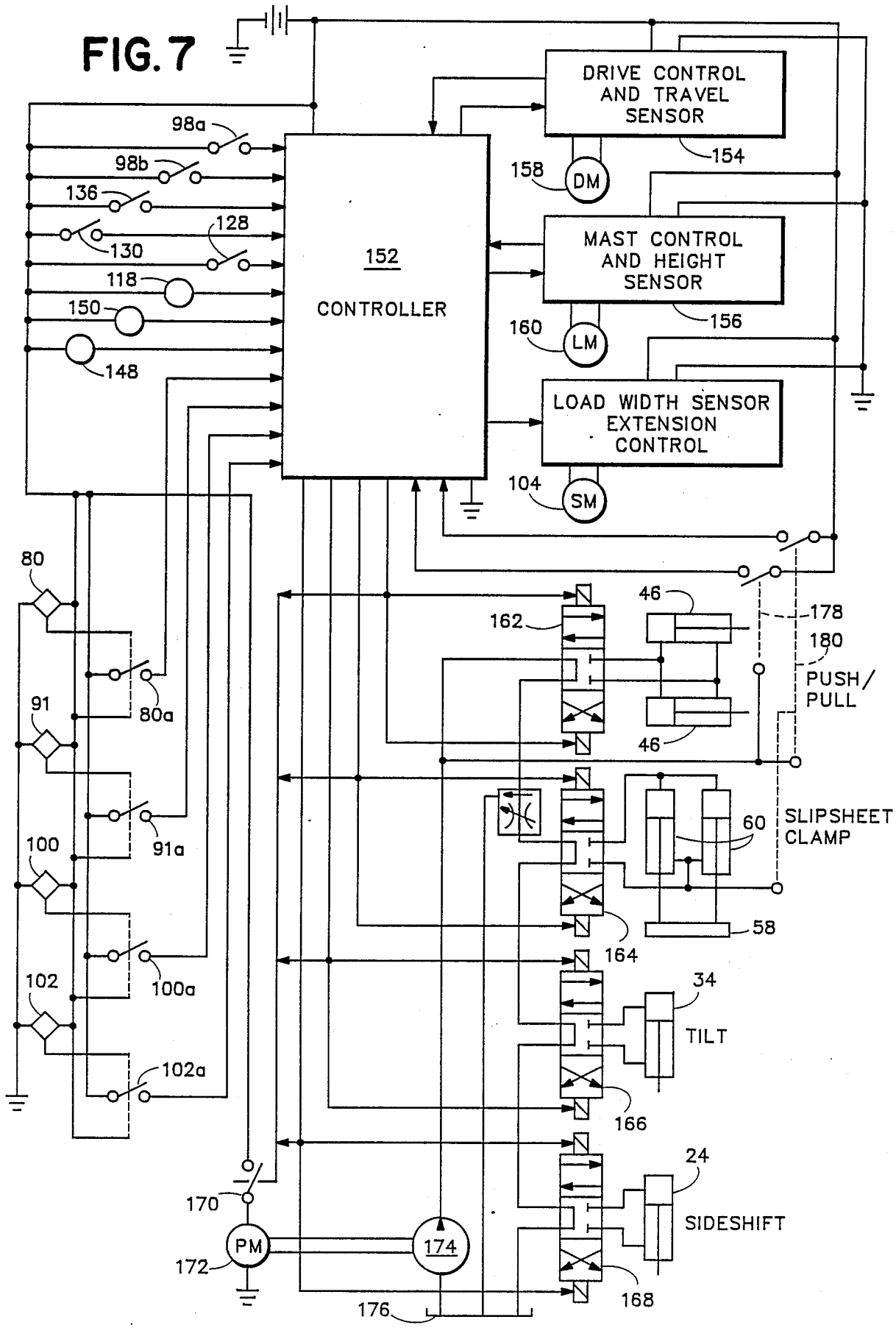
FIG. 7 is a simplified hydraulic and electrical schematic diagram of the push-pull slipsheet handler.

FIG. 7 is a simplified schematic diagram of the electrical and hydraulic circuitry of the slipsheet handler which accomplishes its basic functions. A microcomputer 152 of any suitable type, such as an OMRON SYSMAC-S6 programmable controller, receives signals from the various sensors 80, 91, 98 (comprising a load bump switch **98*a* and a load full-contact switch 98*b*), 100, 102, 118, 128, 130, 136, 148 and 150 previously described, as well as from the drive control and travel sensor 154 of the vehicle 14 and the lift control and height sensor 156 of the mast 12, both of which are conventional. The electro-optical detectors 80, 91, 100 and 102 each send their signals through respective relays 80*a*, 91*a*, 100*a* and 102*a*. Although not shown, the detector 80, long-distance source 76 and short-distance source 78 are each selectively activated and deactivated by respective computer-controlled relays. The microcomputer 152 may also be responsive to a push plate retraction force pressure sensor switch 178, and is responsive to a slipsheet clamp open and close pressure sensor switch 180** for purposes to be described hereafter.

In response to these signals the microcomputer 152 controls the electric drive motor 158 of the vehicle 14, the electric lift motor 160 of the mast 12 which regulates lifting and lowering in a conventional manner, and the width sensor motor 104 which controls the extension and retraction of the sensors 100 and 102. In addition, the microcomputer controls the actuation and direction of the push/pull cylinders 46, the slipsheet clamp cylinders 60, the tilt cylinder 34 and the sideshift cylinder 24 through respective three-position, solenoid-operated, hydraulic valves 162, 164, 166 and 168, while simultaneously controlling the activation and deactivation, through a relay 170, of an electric pump motor 172 which drives a hydraulic pump 174. It should particularly be noted that the valve 164, for the slipsheet clamp cylinders 60, is connected immediately upstream of the valve 166 for the tilt cylinder 34 in the hydraulic reservoir return line. Thus, when valve 164 is actuated to cause cylinders 60 to extend to close the slipsheet clamp, while valve 166 is simultaneously actuated to cause cylinder 34 to retract to cause up-tilting, the oil exhausted from the rod ends of the cylinders 60 flows into the rod end of the tilt cylinder 34. The oil-containing cross-sections of the rod ends of the cylinders 60 bear a relation to the corresponding cross-section of the rod end of the cylinder 34 such that the speed of extension of the upper clamp jaw 58 matches the upward speed of the lower jaw 56 and tips of the platens 16 during clamp closure, for the reasons described previously.

The pump motor 172, the pump 174 and its related hydraulic reservoir 176 may be mounted either on top of the slipsheet handler, or on the vehicle 14 connected to the slipsheet handler by hydraulic lines. Alternatively, a completely electric system may be substituted for the hydraulic system, with electric actuators replacing the various hydraulic cylinders and electrical relays replacing the solenoid-operated valves.

OPERATION

Figure 11A:
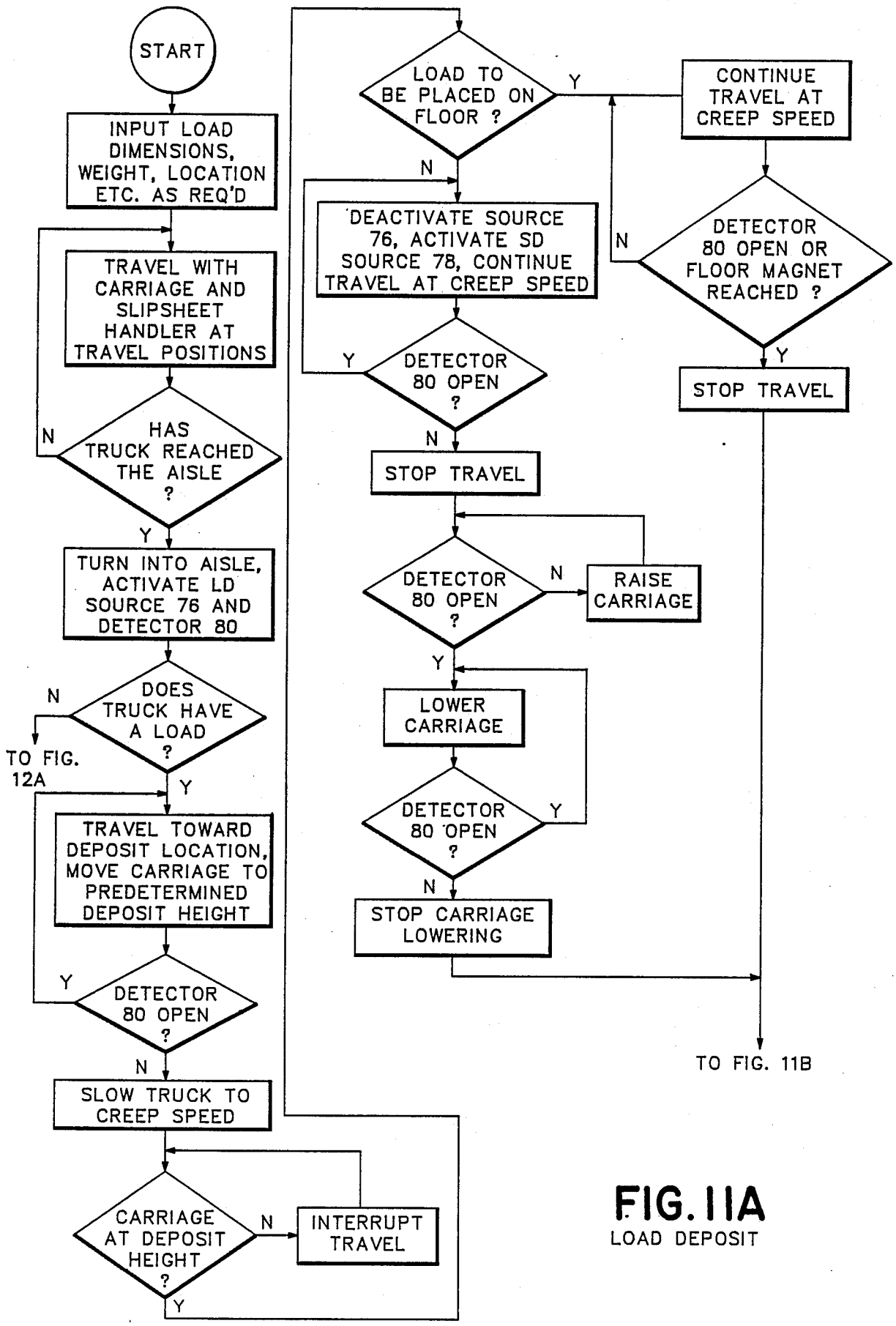
FIGS. 11A–11C are logic flow diagrams according to which the microcomputer controller of the push-pull slipsheet handler is programmed for load depositing.
Figure 11B:
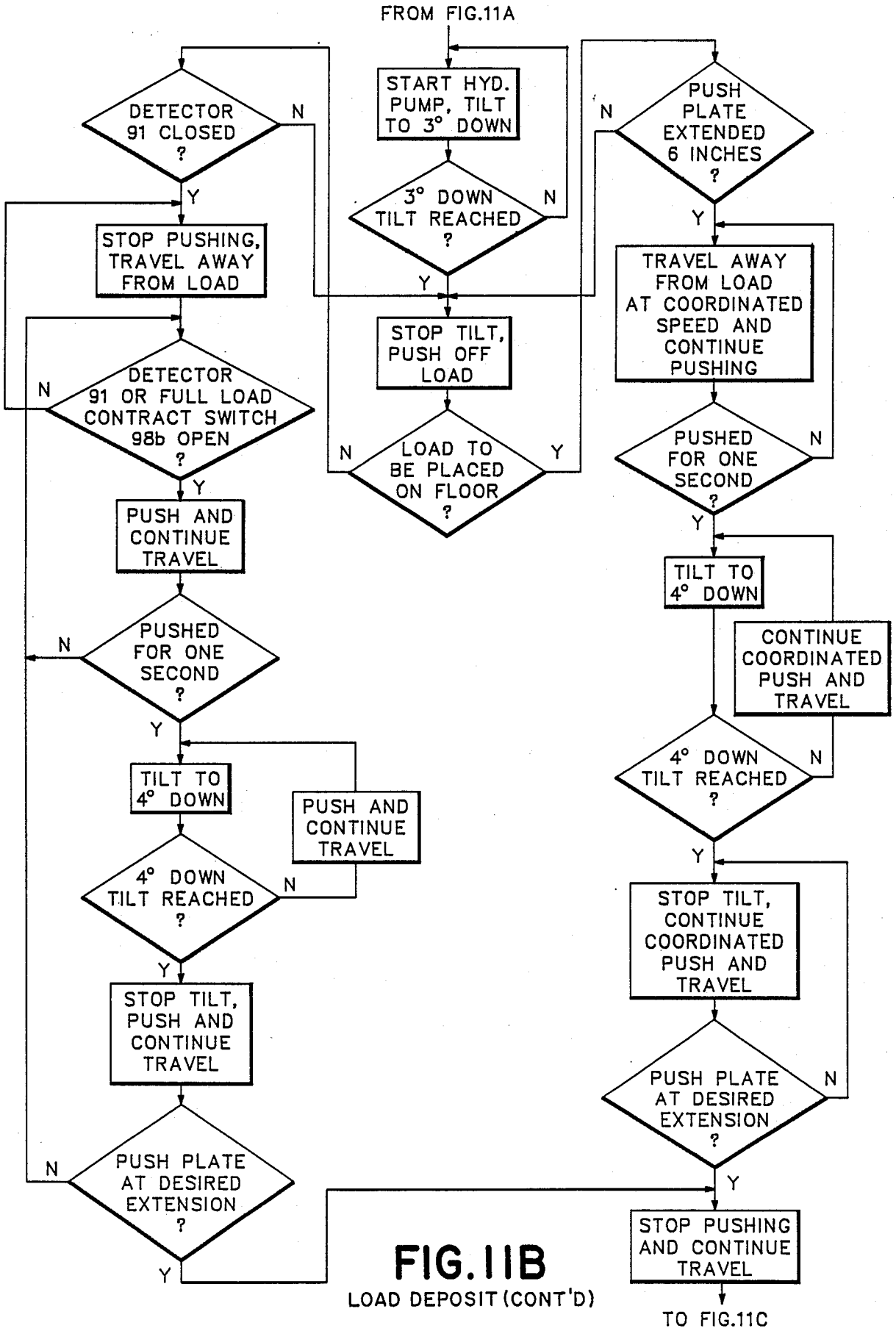
Figure 11C:
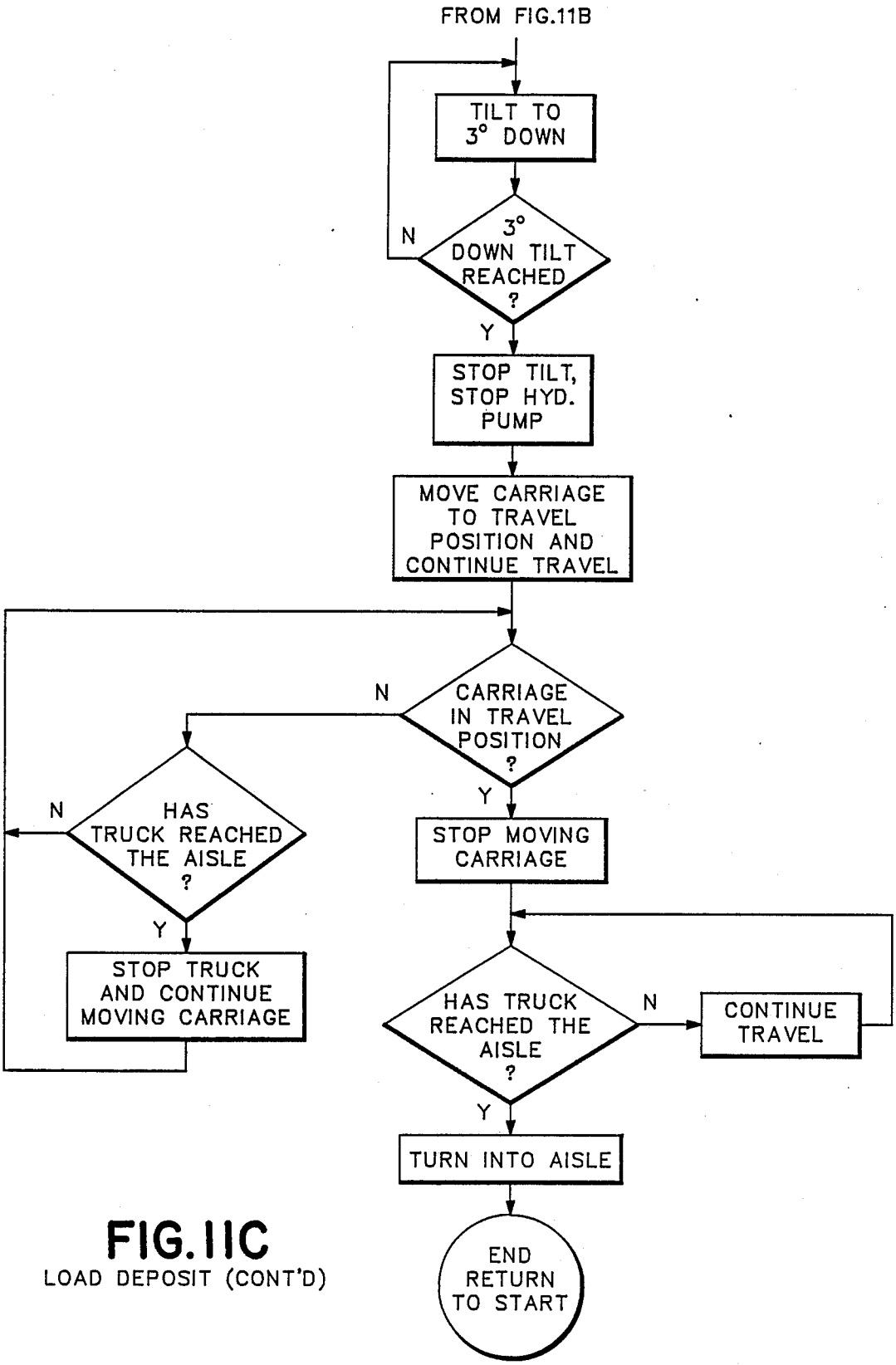
Figure 12A:
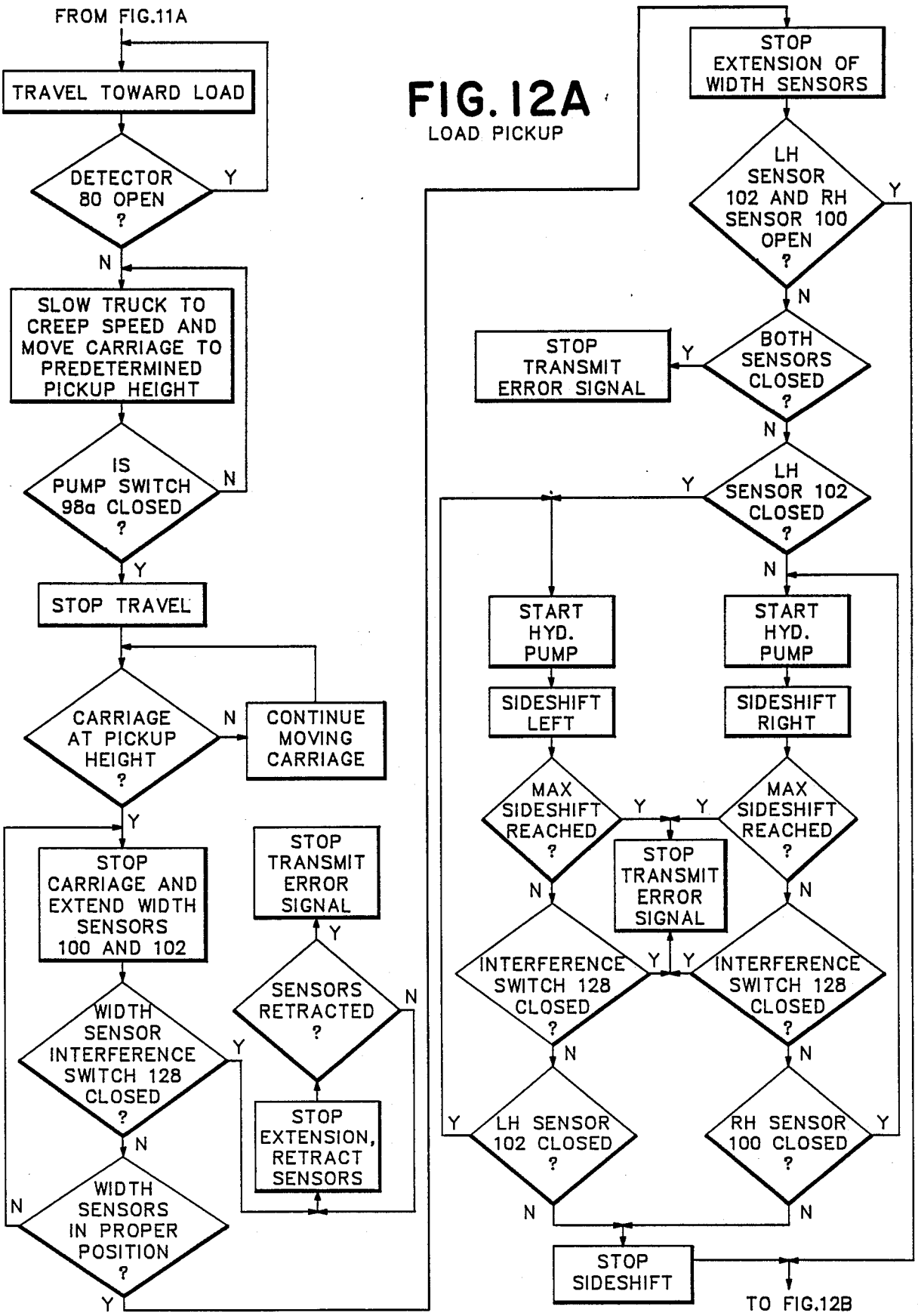
FIGS. 12A–12C are logic flow diagrams according to which the microcomputer controller is programmed for load pickup.
Figure 12B:
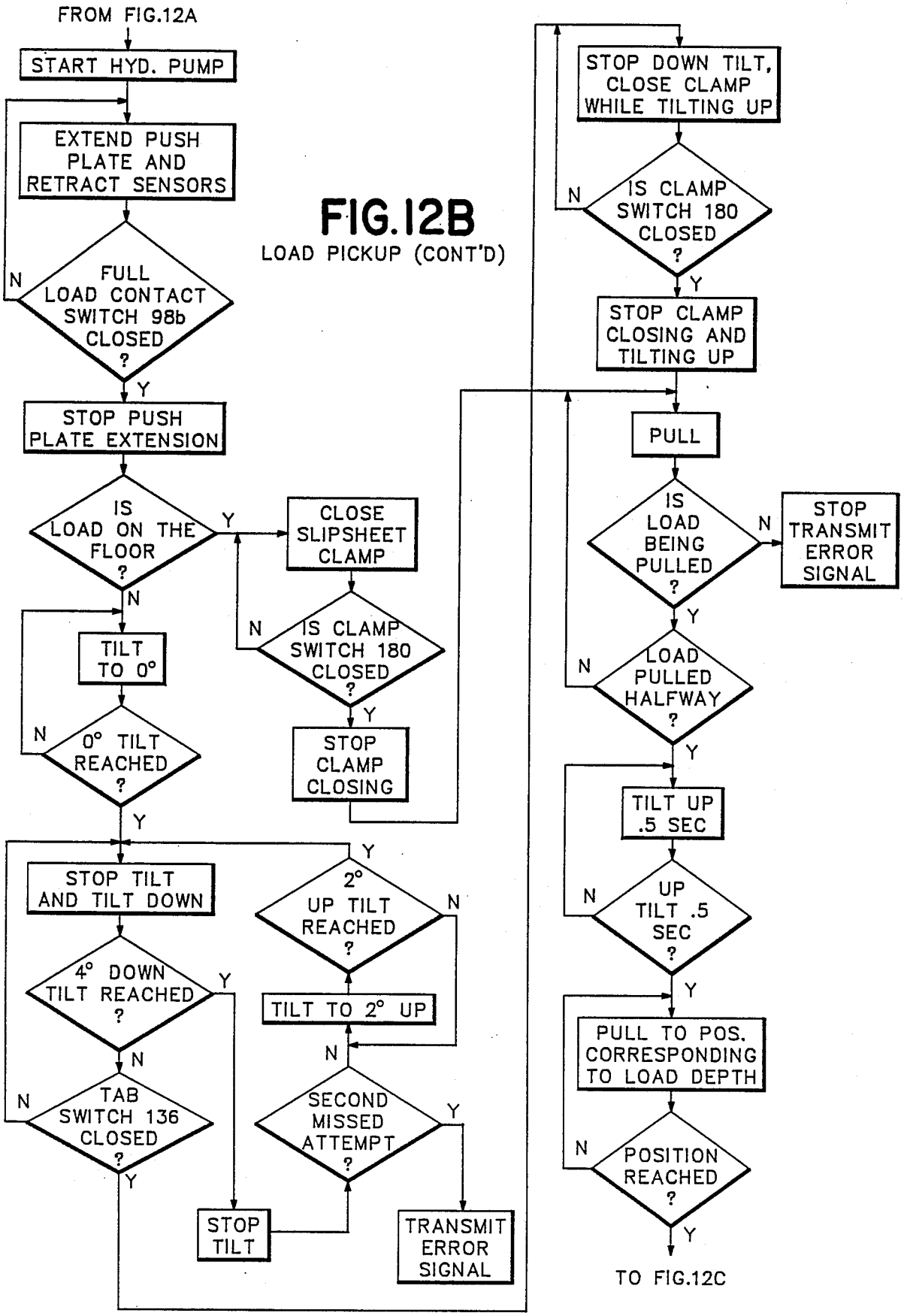
Figure 12C:
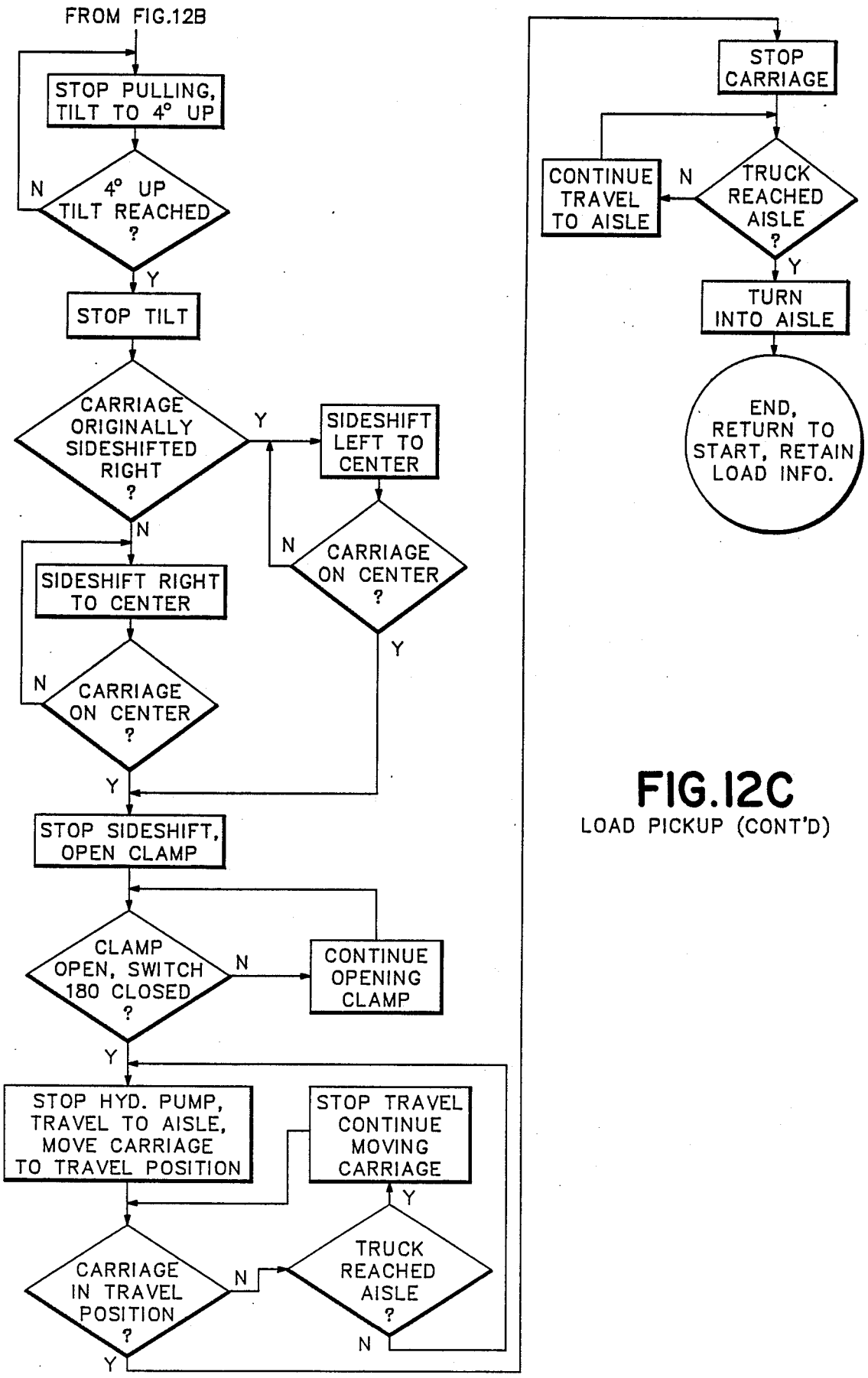

FIGS. 11A–C and 12A–C are simplified logic flow diagrams pursuant to which the microcomputer controller 152 is programmed to operate the automatic slipsheet handler of the present invention. FIGS. 11A–11C are directed to the manner in which the controller 152 controls the deposit of a load by the slipsheet handler, either onto the floor or atop another load. FIGS. 12A–12C show how the controller 152 controls the pick-up of a load, either from the floor or from atop another load.

1. Load Deposit

Initially, the controller's memory is loaded by the warehouse central computer with information regarding the width and depth dimensions of the load or loads to be handled, their location, their weight and any other information that may be required. If the slipsheet handler is carrying a load, the vehicle or truck 14 travels to the appropriate warehouse aisle where the load is to be deposited, with the carriage in the travel position (e.g. with the platen approximately 12 inches above the floor), and the slipsheet handler in the load-carrying travel position (e.g. with the platens tilted at four degrees up-tilt and the push plate fully or partially retracted so that the far side of the load is in alignment with the tips of the platen). The truck turns into the aisle, and activates the long-distance source 76 and its related light detector 80. While the truck travels toward the deposit location, the the controller moves the carriage to the predetermined deposit height for the particular load (which is part of the load "location" information previously entered in the controller's memory). Such deposit height may be on the floor, or may be atop another load. When the detector 80 senses a predetermined threshold light intensity, indicating its proximity to a vertical surface to be used as a reference (such as a wall or the face of another load), switch 80*a* closes. In response, the truck is slowed to creep speed and, if the carriage is not yet at proper deposit height, travel is interrupted until it has reached the desired height.

If the load is to be deposited on the floor, travel toward the load deposit location continues at creep speed until the detector 80 has passed the point of maximum light intensity (i.e. at the point of intersection of the light paths 76' and 80' in FIG. 8) and the intensity has once more dropped below the threshold intensity. This causes the switch 80*a* to open, in response to which the truck is stopped. Alternatively, in some circumstances there may be no vertical surface for the detector 80 to sense in the floor deposit mode, in which case a truck-positioning magnet placed in the floor of the warehouse will normally indicate the point at which the truck is to stop. The controller then actuates the hydraulic pump motor 172 by means of relay 170 and actuates tilt valve 168 so as to tilt the platens to 3° down-tilt, after which valve 162 is actuated to push the load off of the platens. After extending the push plate for a predetermined distance (e.g. six inches) as indicated by the push plate position sensor 150, the truck is directed by the controller to withdraw from the load at the same speed that the push plate is being extended relative to the slipsheet handler frame, in a manner similar to that described in the aforementioned U.S. Pat. Nos. 4,297,070 and 4,284,384 which are incorporated herein by reference. During such coordinated movement of the truck and push plate, the platens are tilted somewhat further down (e.g. to 4° down-tilt) after the push plate has been extended for a predetermined period of time (e.g. one second). The coordinated movement of the truck and push plate continues until the desired extension is indicated by the sensor 150 (e.g. when the front of the push plate is aligned with the tips of the platens), at which time the load has been deposited in a predetermined relationship to the vertical surface originally used as a reference by the light detector 80. Thereafter, pushing stops, the truck continues withdrawing from the load, the platens are tilted to their load pick-up travel positions (e.g. 3° down-tilt), and the carriage is moved to the travel position. The truck moves to the aisle, turns into it and receives instructions for its next mission, i.e. to pick up a load from another location.

If the load is to be deposited atop another load, rather than on the floor as in the previous paragraph, the procedure is somewhat different as shown beginning at the top of the middle logic flow path of FIG. 11A. Rather than utilizing the long-distance light source 76, such light source is deactivated and the short-distance light source 78 is utilized because the intersection of its light path with path 80' of the detector 80 is variably coordinated with the position of the push plate and thus with the face of the load to be deposited, as explained previously. As the truck travels at creep speed toward the load-deposit location with its carriage at deposit height (i.e. with its platens above the top of the lower load), the detector switch 80*a* will close when the threshold light intensity reflected from the face of the lower load is reached. Preferably, the switch 80*a* will close in this mode when the push plate is a relatively short distance (e.g. six inches) from the face of the lower load, as shown in phantom in FIG. 9, with the upper load partially overlapping the lower load in the direction of approach. This ensures that the load will not subsequently be lowered onto the slipsheet tab 82*b* of the forward load 82*a* in FIG. 9, but rather will be lowered behind it and then pushed against it, bending it upward due to its already upwardly-deformed shape resulting from previous folding by the shoulder 146 on the slipsheet clamp. In response to the closure of switch 80*a*, truck travel is stopped and, since the detector switch 80*a* is closed, the carriage is raised until the detector 80 rises above the top of the lower load and thus the switch 80*a* opens. The carriage is then lowered until the switch 80*a* once more closes, indicating the exact height of the top of the lower load. The hydraulic pump motor 172 is started and the platens are tilted to 3° down-tilt, after which tilting is stopped and pushing of the load begins.

Since the load is not to be placed on the floor, but rather in an elevated position atop another load, sensor 91 is used to sense the face of the underlying load and thereby bring the front of the push plate into vertical alignment with such face and maintain it in such alignment as the load is pushed off of the platens. Thus, while the load is initially pushed off but the truck is not yet withdrawing, the switch 91*a* will close at the point of such alignment, and the truck will then begin withdrawing from the lower load as pushing stops. However, the closure of switch 91*a* only momentarily stops the extension of the push plate relative to the frame of the slipsheet handler. As the truck begins to withdraw, the sensor 91 immediately senses a decrease in light intensity below the threshold value due to the corresponding withdrawal of the push plate. Accordingly, switch 91*a* reopens, thereby actuating valve 162 to commence pushing. In this load deposit mode, the simultaneous speeds of truck withdrawal and load pushing are not the same. Rather, the extension speed of the push plate relative to the frame of the slipsheet handler is greater than the speed of withdrawal of the truck. Despite this difference in speed, however, the push plate cannot overshoot the face of the lower load because the reactivation of pushing will immediately raise the light intensity sensed by sensor 91, thereby reclosing switch 91*a* and deactivating valve 162 to stop pushing. In this way, throughout the withdrawal of the truck, the valve 162 is rapidly alternately activated and deactivated to cause intermittent pushing, thereby maintaining the push plate in vertical alignment with the lower load face. As a safety measure, any opening of the full load contact switch 98*b* during withdrawal of the truck will also cause pushing, thereby ensuring against incomplete pushing of the load into its deposit position if sensor 91 should malfunction, and frictional contact with the lower load should prevent the upper load from following the truck's withdrawal. During the truck withdrawal process, after total pushing time has accumulated to a predetermined time (e.g. one second) the carriage is tilted slightly lower (e.g. to four degrees down) to facilitate load depositing. As soon as the push plate has reached the aforementioned desired extension position, as indicated by the sensor 150, pushing stops while the truck continues its withdrawal. Thereafter, operation is the same as described in the previous paragraph with respect to the floor-depositing of a load.

2. Load Pick-Up

If the slipsheet handler is not carrying a load, the controller proceeds in accordance with FIGS. 12A–12C to cause the slipsheet handler to pick up a load. In this case, the travel position of the carriage is the same as for load deposit, but the travel position of the slipsheet handler is with the front of the push plate aligned with the forward tips of the platens but not yet fully extended and the platens at 3° down-tilt. The truck advances toward the load until detector 80, in cooperation with long-distance light source 76, senses sufficient light intensity to close switch 80*a*, in response to which the truck is slowed to creep speed and the carriage is moved to the predetermined pick-up height. Such height may either be at floor level or, in the case of an elevated load, such that the opening between the jaws of the slipsheet clamp is below the expected height of the slipsheet. As the truck approaches the load, the bump switch 98*a* on the push plate will sense initial load contact and stop the advancement of the truck. If the carriage is not yet at pick-up height, it will continue to be moved until such height is reached. Thereafter, width sensors 100 and 102 on the push plate are extended a predetermined distance (e.g. so as to be separated by a distance approximately one inch greater than the preprogrammed width of the load) by actuation of the sensor motor 104. During extension of the sensors 100 and 102, if the interference switch 128 becomes closed due to any resistance encountered by the width sensors, extension is stopped, the width sensors are retracted and an error signal is generated. In the absence of any such interference, the extension of the width sensors to the proper width for the particular load is sensed by the rotary encoder 118 and extension is stopped. If the push plate is properly centered on the load, both sensors 100 and 102 should extend slightly beyond the transversely-opposite sides of the load and should therefore sense insufficient light intensity, thereby causing switches 100*a* and 102*a* to remain open. In such case the load pick-up procedure will continue as described hereafter. However, if both sensors sense a sufficient light intensity that the switches 100*a* and 102*a* are both closed, this means that the load is wider than the preprogrammed dimensions and an error signal is generated. On the other hand, if only one of the two width sensors senses a sufficient light intensity, indicating an off-center condition, the hydraulic pump motor 172 is started and valve 166 is actuated so as to cause cylinder 24 to side-shift the push-pull assembly toward the particular width sensor whose switch is closed, until such time as both width-sensor switches are open indicating proper centering. During this process, if maximum side-shift is reached an error signal is generated indicating that the off-center condition is too great for automatic correction. Likewise, if the extension interference switch 128 closes during such side-shifting, indicating resistance to side-shifting applied against one of the width sensors, an error signal is transmitted. Assuming that the side-shifting is effective to correct the centering problem, or if no centering problem exists, the width sensors are retracted and the push plate is then further extended until the full load contact switch 98*b* closes, in response to which push plate extension is stopped.

If the load is on the floor, valve 164 is actuated to close the slipsheet clamp, such closure being indicated by rising hydraulic pressure sensed by the closure of pressure-sensitive switch 180. In response to the closure of switch 180, valve 162 is actuated to commence pulling of the load onto the platens. During such pulling, whether or not the load is actually being pulled can be sensed in either of two ways. First, if full load contact switch 98*b* opens, indicating that the load has pulled away from the push plate, an error signal can be generated; alternatively, hydraulic pulling pressure can be monitored by pressure sensitive switch 178 and, if the switch opens, indicating insufficient pulling pressure, the same error signal can be generated. During pulling of the load, when a predetermined pulling distance is reached as indicated by sensor 150, up-tilting for a predetermined period of time (e.g. 0.5 seconds) takes place by actuation of valve 168 to stabilize the load on the platens. Pulling ceases when the load has been pulled onto the platens by a distance, again indicated by sensor 150, corresponding to its preprogrammed depth, so that the far side of the load is aligned with the tips of the platens. This sets the point of intersection of the light path of the short-distance light source 78 with the path 80′ of the detector 80, for use in subsequent depositing of the load atop another load in the manner previously described. After pulling has stopped, the handler is tilted to a 4° up position by actuation of valve 168 and is then side-shifted relative to the truck to recenter the push-pull handler on the truck if necessary, such recentering being indicated by switch 130. The slipsheet clamp is then opened and the truck travels to the aisle while moving the carriage to its normal travel position.

If an elevated load supported atop a lower load is to be picked up, rather than a floor-supported load as in the previous paragraph, the procedure is the same except with respect to slipsheet clamping. Upon approach to the load, after push plate extension has been halted in response to the closure of the full load contact switch **98*b*, a special slipsheet clamping procedure is instituted in view of the fact that the slipsheet may not be precisely at the height expected due to such factors as compression of the lower load. Because of this variable, which does not occur in the pick-up of loads from the floor, the carriage is raised to a predetermined height, in preparation for load engagement, so that the slipsheet clamp jaw opening is below the expected height of the slipsheet. After push plate extension is stopped in response to the closure of switch 98*b*, the platens are tilted upwardly from their normal downwardly tilted load pick-up travel attitude to 0° (i.e. approximately horizontal) pursuant to FIG. 12B. This lifts the jaw opening from the position shown in FIG. 10A to that shown in FIG. 10B, enabling the slipsheet tab to enter the open jaw or be urged into the jaw by the rearwardly beveled surface of sensor bar 134 upon subsequent down-tilting. Tilting is then reversed until either the slipsheet sensor switch 136 (actuated by the sensor bar 134) closes, or a maximum down-tilt is reached. In the former case, i.e. if the switch 136 closes indicating the presence of the slipsheet tab in a position to be clamped, down-tilting is abruptly stopped (FIG. 10C) and the clamp is closed by extending upper jaw 58 while simultaneously tilting the clamp up to raise the lower jaw at the same speed as the speed of extension of the upper jaw, as shown in FIG. 10D. However, if the switch 136 has not closed prior to the unit reaching maximum down-tilt, the unit is tilted to a higher position than previously, after which the unit is tilted back down to determine again if the tab sensor switch 136** can be closed. If so, the clamp is closed in the manner just described. If not, the fact that two attempts to engage the slipsheet tab have failed causes an error signal to be transmitted. Of course, if desired, provision could be made for still further tries, either by tilting the unit to yet a higher level or by raising the carriage. After the slipsheet is clamped, load pulling and transporting proceeds in the manner previously described for the pickup of floor-supported loads.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A push-pull slipsheet handler comprising:

(a) a forwardly-extending load-carrying member for supporting a load;

(b) a push-pull assembly comprising a frame, a push plate, power means mounted on said frame for selectively extending said push plate in a forward direction and retracting said push plate in a rearward direction relative to said frame, and selectively openable and closable jaw means on said push plate for gripping a slipsheet and thereby engaging said load forwardly of said push plate;

(c) sensor means mounted on said push plate for sensing the proximity of said load to said push plate; and (d) control means responsive to said sensor means, said control means including means for moving said frame in said forward direction and stopping the forward movement of said frame in response to the sensing by said sensor means of a first predetermined proximity of said load to said push plate, said control means further including means for causing said power means to extend said push plate after said stopping and then interrupt the extension of said push plate relative to said frame in response to the sensing by said sensor means of a second predetermined proximity of said load to said push plate which is greater than said first predetermined proximity, and for causing said jaw means thereafter to grip said slipsheet at said second predetermined proximity.

2. A push-pull slipsheet handler comprising:

(a) a forwardly-extending load-carrying member for supporting a load;

(b) a push-pull assembly comprising a frame, a push plate, power means mounted on said frame for selectively extending said push plate in a forward direction and retracting said push plate in a rearward direction relative to said frame, and selectively openable and closable jaw means on said push plate for gripping a slipsheet and thereby engaging said load forwardly of said push plate;

(c) sensor means mounted on said push plate for sensing the proximity of said load to said push plate; and (d) control means for selectively withdrawing said frame from said load and, during such withdrawal, extending said push plate relative to said frame in response to the sensing by said sensor means of less than a predetermined proximity of said load to said push plate.

3. A push-pull slipsheet handler comprising:

(a) a forwardly-extending load-carrying member for supporting a load;

(b) a push-pull assembly comprising a frame, a push plate, power means mounted on said frame for selectively extending said push plate in a forward direction and retracting said push plate in a rearward direction relative to said frame so as to move said load relative to said load-carrying member, and selectively openable and closable jaw means on said push plate for gripping a slipsheet and thereby engaging said load for retraction thereof;

(c) memory means for storing variable information indicative of the respective different distances between the extremities of different loads in said forward and rearward directions;

(d) said power means including means responsive to said memory means for causing interruptions of the retraction of said push plate relative to said frame at variable distances from said frame dependent upon said variable information so that, when said interruptions occur, the forwardly-extending extremity of said load-carrying member does not protrude forwardly substantially beyond the forward extremities of said different loads.

4. A push-pull slipsheet handler comprising:

(a) a load-carrying member for supporting a load having opposite extremities;

(b) a push-pull assembly comprising a frame, a push plate, power means mounted on said frame for selectively extending said push plate in a direction of extension and retracting said push plate in an opposite direction relative to said frame so as to move said load relative to said load-carrying member, and selectively openable and closable jaw means on said push plate for gripping a slipsheet and thereby engaging said load;

(c) sensor means for sensing the positions of said opposite extremities of said load relative to said push-pull assembly when said opposite extremities are separated by a width dimension transverse to said direction of extension; and (d) control means responsive to said sensor means for moving said push-pull assembly transversely relative to said direction of extension to a predetermined position with respect to said width dimension.

5. The apparatus of claim 4, further including extension means for selectively extending and retracting said sensor means transversely with respect to said direction of extension.

6. A push-pull slipsheet handler comprising:

(a) a load-carrying member for supporting a load having opposite extremities;

(b) a push-pull assembly comprising a frame, a push plate, power means mounted on said frame for selectively extending said push plate in a direction of extension and retracting said push plate in an opposite direction relative to said frame so as to move said load relative to said load-carrying member, and selectively openable and closable jaw means on said push plate for gripping a slipsheet and thereby engaging said load;

(c) sensor means for sensing the positions of said opposite extremities of said load relative to said push-pull assembly when said opposite extremities are separated by a width dimension transverse to said direction of extension; and (d) memory means for storing variable information indicative of the respective different widths of different loads between their respective opposite extremities, and control means responsive to said sensor means and said memory means for determining if the width dimension between said opposite extremities, as sensed by said sensor means, is greater than a predetermined width indicated by said variable information stored in said memory means and, if so, transmitting a signal in response thereto indicating a malfunction.

7. A push-pull slipsheet handler comprising:

(a) a forwardly-extending load-carrying member for supporting a load;

(b) a push-pull assembly comprising a frame, a push pate, power means mounted on said frame for selectively extending said push plate in a direction of extension and retracting said push plate in an opposite direction relative to said frame so as to move said load relative to said load-carrying member, and selectively openable and closable jaw means on said push plate for gripping a slipsheet and thereby engaging said load;

(c) said jaw means comprising a lower jaw and an upper jaw, one of said jaws being fixedly mounted on said push plate and te other of said jaws being mounted for reciprocation with respect to said push plate in a direction transverse to said direction of extension; and (d) control means for moving said push plate and said one of said jaws in unison in a direction transverse to said direction of extension at a first speed, and simultaneously moving said other of said jaws with respect to said push plate transversely to said direction of extension at a second speed to close said jaw means, while automatically coordinating said first and second speeds so that said speeds are substantially equal.

8. A push-pull slipsheet handler for depositing a load in a predetermined relationship to a vertically-oriented surface comprising:

(a) a forwardly-extending load-carrying member for supporting a load;

(b) a push-pull assembly comprising a frame, a push plate, power means mounted on said frame for selectively extending said push plate relative to said frame in a forward direction so as to move said load in said forward direction relative to said load-carrying member, and selectively openable and closable jaw means on said push plate for gripping a slipsheet;

(c) sensor means connected to said push-pull assembly for sensing, while said load is supported on said load-carrying member, the presence of a vertically-oriented surface forwardly of said push-pull assembly and the proximity, in said forward direction, of said vertically-oriented surface to a predetermined portion of said push-pull assembly;

(d) control means responsive to said sensor means for causing said push-pull assembly to deposit said load in a predetermined relationship, in said forward direction, to said vertically-oriented surface; and (e) means for moving said sensor means relative to said push-pull assembly in response to variations in the extensible position of said push plate relative to said frame.

9. A push-pull slipsheet handler comprising:

(a) a forwardly-extending load-carrying member for supporting a load having transversely opposite extremities;

(b) a push-pull assembly comprising a frame, a push plate, power means mounted on said frame for selectively extending said push plate in said forward direction and retracting said push plate in a rearward direction relative to said frame so as to move said load relative to said load-carrying member, and selectively openable and closable jaw means on said push plate for gripping a slipsheet and thereby engaging said load forwardly of said push plate;

(c) sensor means for sensing the positions of said transversely opposite extremities of said load relative to said push-pull assembly;

(d) control means responsive to said sensor means for moving said push-pull assembly transversely relative to said load so as to place said push-pull assembly in a predetermined transverse position relative to said transversely opposite extremities; and (e) further sensor means for sensing the proximity of said load to said push plate, said control means including means responsive to said further sensor means for moving said push-pull assembly transversely relative to said load in response to the sensing by said further sensor means of a predetermined proximity of said load to said push plate.

10. A push-pull slipsheet handler comprising:

(a) a forwardly-extending load-carrying member for supporting a load having transversely opposite extremities;

(b) a push-pull assembly comprising a frame, a push plate, power means mounted on said frame for selectively extending said push plate in said forward direction and retracting said push plate in a rearward direction relative to said frame so as to move said load relative to said load-carrying member, and selectively openable and closable jaw means on said push plate for gripping a slipsheet and thereby engaging said load forwardly of said push plate; and (c) sensor means mounted on said push plate for sensing the positions of said transversely opposite extremities of said load relative to said push-pull assembly.

11. A push-pull slipsheet handler comprising:

(a) a forwardly-extending load-carrying member for supporting a load having transversely opposite extremities;

(b) a push-pull assembly comprising a frame, a push plate, power means mounted on said frame for selectively extending said push plate in said forward direction and retracting said push plate in a rearward direction relative to said frame so as to move said load relative to said load-carrying member, and selectively openable and closable jaw means on said push plate for gripping a slipsheet and thereby engaging said load forwardly of said push plate;

(c) first sensor means for sensing the positions of said transversely opposite extremities of said load relative to said push-pull assembly;

(d) extension means for selectively extending and retracting said first sensor means transversely with respect to said slipsheet handler; and (e) second sensor means for sensing resistance to the extension of said first sensor means with respect to said slipsheet handler and interrupting said extension in response to said resistance.

12. A push-pull slipsheet handler for depositing a load in a predetermined relationship to a vertically-oriented surface comprising:

(a) a load-carrying member for supporting a load;

(b) a push-pull assembly comprising a frame, a push plate, power means mounted on said frame for selectively extending said push plate relative to said frame in a direction of extension so as to move said load in said direction of extension relative to said load-carrying member and thereby deposit said load, and selectively openable and closable jaw means on said push plate for gripping a slipsheet;

(c) sensor means connected to said push-pull assembly for sensing, while said load is supported on said load-carrying member, the presence of a vertically oriented surface located below said load-carrying member and the proximity, in said direction of extension, of said push plate to said vertically-oriented surface;

(d) control means for moving said frame of said push pull assembly away from said vertically-oriented surface while simultaneously causing said power means to extend said push plate relative to said frame, said control means including means responsive to said sensor means for coordinating the simultaneous movement of said frame and extension of said push plate so as to maintain said push plate at a substantially constant predetermined proximity, as sensed by said sensor means, in said direction of extension to said vertically-oriented surface during said simultaneous movement of said frame and extension of said push plate; and (e) said sensor means being connected to said push plate so as to extend in unison therewith relative to said frame.

* * * * *

UNITED STATES PATENT AND TRADEMARK OFFICE

CERTIFICATE OF CORRECTION

PATENT NO. : 4,861,223

DATED : August 29, 1989

INVENTOR(S) : John E. Olson

It is certified that error appears in the above-identified patent and that said Letters Patent is hereby corrected as shown below:

Col. 7, line 8 Change "reaction" to --retraction--;

Col. 17, line 61 Change "pate" to --plate--;

Col. 18, line 3 Change "te" to --the--.

Signed and Sealed this

Fourth Day of June, 1991

*Attest:*

HARRY F. MANBECK, JR.

*Attesting Officer*

*Commissioner of Patents and Trademarks*